US009670918B2

(12) United States Patent
Mueller

(10) Patent No.: US 9,670,918 B2
(45) Date of Patent: Jun. 6, 2017

(54) WATER BOOSTER CONTROL SYSTEM AND METHOD

(71) Applicant: Robert A. Mueller, Yorkville, IL (US)

(72) Inventor: Robert A. Mueller, Yorkville, IL (US)

(73) Assignee: Pentair Flow Technologies, LLC, Delavan, WI (US)

( * ) Notice: Subject to any disclaimer, the term of this patent is extended or adjusted under 35 U.S.C. 154(b) by 443 days.

(21) Appl. No.: 14/252,309

(22) Filed: Apr. 14, 2014

(65) Prior Publication Data

US 2014/0309796 A1 Oct. 16, 2014

Related U.S. Application Data

(60) Provisional application No. 61/811,565, filed on Apr. 12, 2013.

(51) Int. Cl.
*G05D 7/00* (2006.01)
*F04B 17/04* (2006.01)
(Continued)

(52) U.S. Cl.
CPC ..... *F04B 17/04* (2013.01); *F04B 49/06* (2013.01); *F04B 49/08* (2013.01); *F04B 49/103* (2013.01); *F04B 49/106* (2013.01)

(58) Field of Classification Search
CPC ..... F04B 17/04
(Continued)

(56) References Cited

U.S. PATENT DOCUMENTS 3,229,639 A 1/1966 Hignutt et al.
3,369,489 A 2/1968 Schaub
(Continued)

FOREIGN PATENT DOCUMENTS

CN 202689105 U 1/2013
EP 2527543 A 11/2012
KR 1998082062 A 11/1998

OTHER PUBLICATIONS

Al Suleimani, Zaher, and N. R. Rao. "Wind-powered electric water-pumping system installed in a remote location." Applied Energy 65.1 (2000): pp. 339-347.*
(Continued)

*Primary Examiner* — Satish Rampuria
(74) *Attorney, Agent, or Firm* — Quarles & Brady LLP

(57) ABSTRACT

A water booster control system designed with a controller having an algorithm that determines optimum starting parameters for one or more pumps is disclosed. The water booster control system supplies water to a location at specified operating parameters. Water enters a suction manifold, travels through pipes, and into the pumps. The pumps accelerate the water to the desired pressure and/or flow rate and discharge the water through pipes and out of a discharge manifold. One or more of the components of the water booster control system are monitored during use, and data regarding the parameters is displayed locally and/or remotely. Alarms are specified relating to one or more of the operating parameters and the alarm conditions may be displayed locally and/or remotely. A user may make modifications to the system locally and/or remotely through a screen and/or through a remote device using a smart phone application.

15 Claims, 9 Drawing Sheets

(51) Int. Cl.
*F04B 49/06* (2006.01)
*F04B 49/08* (2006.01)
*F04B 49/10* (2006.01)

(58) Field of Classification Search
USPC ..... 700/275–306
See application file for complete search history.

(56) References Cited

U.S. PATENT DOCUMENTS 3,511,579 A 5/1970 Gray
3,639,081 A 2/1972 Gray
3,746,471 A 7/1973 Gray
3,775,025 A 11/1973 Maher
4,120,033 A 10/1978 Corso
4,290,735 A 9/1981 Sulko
4,584,654 A 4/1986 Crane
4,897,022 A 1/1990 Hudson
4,918,585 A 4/1990 Miller et al.
5,240,380 A * 8/1993 Mabe ..... F04D 15/0066 417/43
5,522,707 A 6/1996 Potter
5,540,555 A 7/1996 Corso
5,581,486 A 12/1996 Terada
5,636,971 A 6/1997 Renedo
5,742,500 A 4/1998 Irvin
5,941,690 A * 8/1999 Lin ..... F04B 49/065 417/44.2
6,178,291 B1 1/2001 Zenios
6,178,393 B1 1/2001 Irvin
6,186,743 B1 2/2001 Romer
6,199,018 B1 3/2001 Quist
6,257,833 B1 7/2001 Bates
6,312,589 B1 * 11/2001 Jarocki ..... B67D 1/0015 210/103
6,688,320 B2 * 2/2004 Frasure ..... F04D 15/0066 137/12
6,829,542 B1 12/2004 Reynolds
6,990,431 B2 1/2006 Beaudoin et al.
6,999,840 B2 2/2006 Brezina
7,010,393 B2 * 3/2006 Mirsky ..... F04D 15/029 417/1
7,143,016 B1 * 11/2006 Discenzo ..... G05B 13/0265 703/3
7,602,128 B2 10/2009 Kling
7,854,597 B2 * 12/2010 Stiles, Jr. ..... F04B 49/20 210/167.1
7,979,240 B2 7/2011 Fielder
8,174,402 B2 5/2012 Bouse
8,297,937 B2 10/2012 Johnson
8,328,523 B2 12/2012 Kernan et al.
8,436,559 B2 5/2013 Kidd et al.
2005/0123408 A1 6/2005 Koehl
2008/0003114 A1 * 1/2008 Levin ..... F04B 49/002 417/306
2011/0091329 A1 4/2011 Stiles, Jr. et al.
2012/0230846 A1 9/2012 Stephens
2013/0108473 A1 5/2013 Tamminen

OTHER PUBLICATIONS

Nam-Cheol, Cho, et al. "An experimental study on the airlift pump with air jet nozzle and booster pump." Journal of Environmental sciences 21 (2009): pp. S19-S23.*
Pedersen, Gerulf KM, and Zhenyu Yang. "Efficiency Optimization of a Multi-pump Booster system." Proceedings of the 10th annual conference on Genetic and evolutionary computation. ACM, 2008. pp. 339-347.*
International Search Report and Written Opinion of the International Searching Authority issued in PCT Application PCT/US2014/034004, mailed Aug. 29, 2014, 11 pages.

* cited by examiner

370

| Alarm Setting | Pump 1 | Pump 2 | Pump 3 | Pump 4 |
|---|---|---|---|---|
| Starts | 999999 | 999999 | 999999 | 999999 |
| Alarm Default | 999999 | 999999 | 999999 | 999999 |
| T # of Starts | 999999 | 999999 | 999999 | 999999 |
| Pump Hours | 999999 | 999999 | 999999 | 999999 |
| Alarm Default | 999999 | 999999 | 999999 | 999999 |
| Total Hours | 999999 | 999999 | 999999 | 999999 |
| Motor Hours | 999999 | 999999 | 999999 | 999999 |
| Alarm Default | 999999 | 999999 | 999999 | 999999 |
| Total Hours | 999999 | 999999 | 999999 | 999999 |
| VFD Hours | 999999 | 999999 | 999999 | 999999 |
| Alarm Default | 999999 | 999999 | 999999 | 999999 |
| Total Hours | 999999 | 999999 | 999999 | 999999 |

Set Default to -1 to Disable Alarm

FIG. 12

380

| Alarm Setting | | |
|---|---|---|
| Pressure Transducer Hours | 999999 | |
| Discharge Alarm Default | 999999 | |
| Total Hours | 999999 | |
| Pressure Transducer Hours | 999999 | |
| Suction Alarm Default | 999999 | |
| Total Hours | 999999 | |
| Flow Transducer Hours | 999999 | |
| Alarm Default | 999999 | |
| Total Hours | 999999 | |

Set Default to -1 to Disable Alarm

Menu Home

FIG. 13

WATER BOOSTER CONTROL SYSTEM AND METHOD

CROSS REFERENCE TO RELATED APPLICATIONS

This application claims the benefit of U.S. Provisional Patent Application No. 61/811,565 filed on Apr. 12, 2013, the entire contents of which are incorporated herein by reference.

BACKGROUND

Water is typically supplied to commercial, industrial, and municipal locations through a distribution system having various pumps and pipes that are in fluid communication with a water supply. In some instances, water must be transported over a long distance through a location in a horizontal and/or vertical manner. To assist in water transport, water booster systems are employed to assist in distributing water appropriately throughout the location.

Typical water booster systems utilize a controller that must cycle through a complete startup and/or shutdown sequence. In particular, a user must set specific use parameters for the booster system and the system executes the operation according to the input parameters. In many situations, the user is unable to adjust the operating parameters of the system during use, even if outside variables are modified during use (e.g., consumption in numerous areas in the location are significantly increased or decreased over a certain time period).

Operation of conventional water booster systems also may be challenging due to the operators not having familiarity with the complexity of variable speed drives, controllers, and the programming required to set up the systems for efficient operation. In particular, conventional water booster systems require specialized controllers and/or programming knowledge depending on the desired settings for the water system. For example, in some instances, a user may be required to purchase and install a specific controller that matches the desired pump sequence.

Conventional water booster systems also suffer from numerous other operational drawbacks. In particular, many water booster control systems come with pre-defined alarm conditions that do not allow for user adjustment or tailoring based on the needs of the user. Further, the alarm conditions of many water booster control systems trigger an onsite alarm that requires maintenance personnel to physically be present onsite to assess the severity of the alarm condition.

One known water booster system discloses a vacuum pump having a control device for processing operational data and instructions provided by the user. The vacuum pump includes a touch screen interface for displaying the operational data that is callable from the control device. The user may input the operational data through the touch screen interface, which is connected to the control device via a data line. The touch screen comprises a start key, a stop key, and an input key. Actuation of one of the keys on the touch screen interface is detected by the control device and appropriate further program steps are ordered and executed. By actuating the start key, for example, a start signal is output by a processor to the control device, whereupon the control device induces the start of a pump aggregate. Similarly, by actuating the stop key, for example, a stop signal is output to the control device, inducing the pump aggregate to stop the pump activity. However, once the start key is actuated, thereby starting the pump activity, the user is unable to actuate the input key to adjust the operational data.

Another system provides a control system for liquid pressure booster systems. The control system sequences pumps coupled to a common source of varying pressure to maintain the pressure in a discharge conduit at a constant level for all flow rates. The system includes a plurality of constant-speed pumps coupled in common to the source of pressurized fluid. Each of the pumps is connected in parallel to an output or system conduit by means of pressure regulating valves. Additionally, a flow signal generator is provided and includes an output line for each predetermined flow rate level at which the system is designed to energize or de-energize a different combination of pumps. For example, when the liquid flow rate is above a first preset level a first output line is energized to start a first pump. When the flow further increases to a higher level, a second output line is energized to start a second pump, for example. The output line of the flow signal generator feeds one input of an AND gate, and the other input of the AND gate is received from a preset pressure switch that senses the discharge pressure of the first pump. Further, the preset pressure switch is set to actuate at a level slightly above the desired output pressure of the discharge conduit. Thus, the control system requires the user determine several preset operating parameters, as well as understand a complex logic function to program the system for efficient operation.

Another system provides a maintenance reminder system for a pump. The maintenance reminder system is coupled to the pump, or the control system for the pump, and determines the volume of fluid pumped by the pump. A piston pump may be used and piston strokes are counted and converted to a total value of liquid pumped. A computer associated with the system maintains a database for each maintenance item, which contains the threshold value for each item and the total volume of liquid pumped since the last maintenance. Thus, when the total volume exceeds the threshold, a maintenance reminder is displayed and the computer may display information from the database at to which item needs service. While the user may adjust the threshold value for a particular maintenance item, the system does not permit the user to access the database containing the threshold values remotely. Rather, the computer and database of the system is attached directly to the pump control system.

In yet another system, a system is provided for monitoring and determining pump failure. The system includes one or more power circuits, a current sensing circuit, an alarm circuit, and a controller. The controller is connectable to and receives an input from the current sensing circuit. The controller is configured to calculate a baseline operating current, current thresholds, and operating conditions affecting operation of the pump. The alarm circuit is connectable to and receives outputs from the controller, and provides alarm indications corresponding to operating conditions determined by the controller. While a user of the system may receive the alarm indications remotely from the system, the user is unable to remotely adjust the alarm thresholds. Thus, when an alarm indication is generated by the system, maintenance personnel are required to be physically present onsite to assess the severity of the alarm condition.

Therefore, it would be desirable to provide a system and method that addresses one or more of the needs described above. More particularly, it would be desirable to provide a water control booster system that allows an operator of the system to identify specific operating parameters, as well as adjust the operating parameters while the system is in use.

It would also be desirable to provide a water control booster system that uses a controller having an algorithm stored thereon to control one or more of the operating parameters of the system, such as the speed of one or more of the pumps included in the water control booster system. Thus, the water control booster system would require little to no complex programming. A water control booster system that provides customizable alarm thresholds that may be transmitted to the user remotely is also desirable. More particularly, if one of the alarm thresholds is breached, it is beneficial to allow the user to view, address, and/or modify the alarms from a remote device.

SUMMARY

The disclosure relates generally to a water booster control system, and more specifically to a water booster control system designed with a controller having an algorithm that determines starting parameters for one or more pumps.

The water booster control system is designed to offer variable speed control of one or more pumps by utilizing a touch screen terminal with only minimal setup to initially program and start the system. The controller utilized in conjunction with the water booster control system allows the end user to select how the pumps are utilized (e.g., sequence pumps by time, by first on/first off, or by selecting a permanent lead pump) without the need to physically change the controller or input specialized software programming code. The adjustment of the controller may be undertaken at any time in the life cycle of the water booster control system including while the pumps are in use. Additionally, the controller includes an "auto-detect" function that automatically adjusts the pumps start and stop times to maximize the efficiency of the water booster control system while increasing the life of the pumps. The controller further includes customizable maintenance alarms to provide notifications remotely to the end user, which provides more time to schedule maintenance rather than execute emergency repairs.

In one embodiment of the disclosure, a water booster control system comprises a controller in communication with one or more drive units designed to control the operating parameters of one or more pumps. The controller further includes an algorithm designed to determine at least one parameter associated with the one or more pumps. The water booster control system is further designed to allow a user to enter one or more customizable alarm thresholds that are transmitted to the user remotely when the thresholds are breached.

In a different embodiment of the disclosure, a method of operating pumps in a water booster control system includes the step of calculating one or more operating parameters of one or more pumps using an algorithm that utilizes a proportional integral derivative loop that determines the difference between a set process variable and a desired set point.

Another embodiment of the disclosure provides a method of operating one or more pumps while in operation. The method includes selecting a first pump parameter on a computer implemented user interface. The first pump parameter is defined by a pump sequence mode selection, a pump rotation selection, or a lead pump selection. An alarm indicating a fault condition is received, and the alarm is transmitted to an offsite location. At the offsite location, the alarm is reviewed and a response is transmitted to one or more of the pumps. The first pump parameter is adjusted in response to the alarm.

These and other features, aspects, and advantages of the present invention will become better understood upon consideration of the following detailed description, drawings, and appended claims.

BRIEF DESCRIPTION OF THE DRAWINGS

FIG. 12 is a schematic representation of a screen showing operating conditions of one or more pumps used in the water booster control system of FIG. 1;

FIG. 13 is a schematic representation of a screen showing operating conditions of one or more transducers used in the water booster control system of FIG. 1;

DETAILED DESCRIPTION

Figure 1:
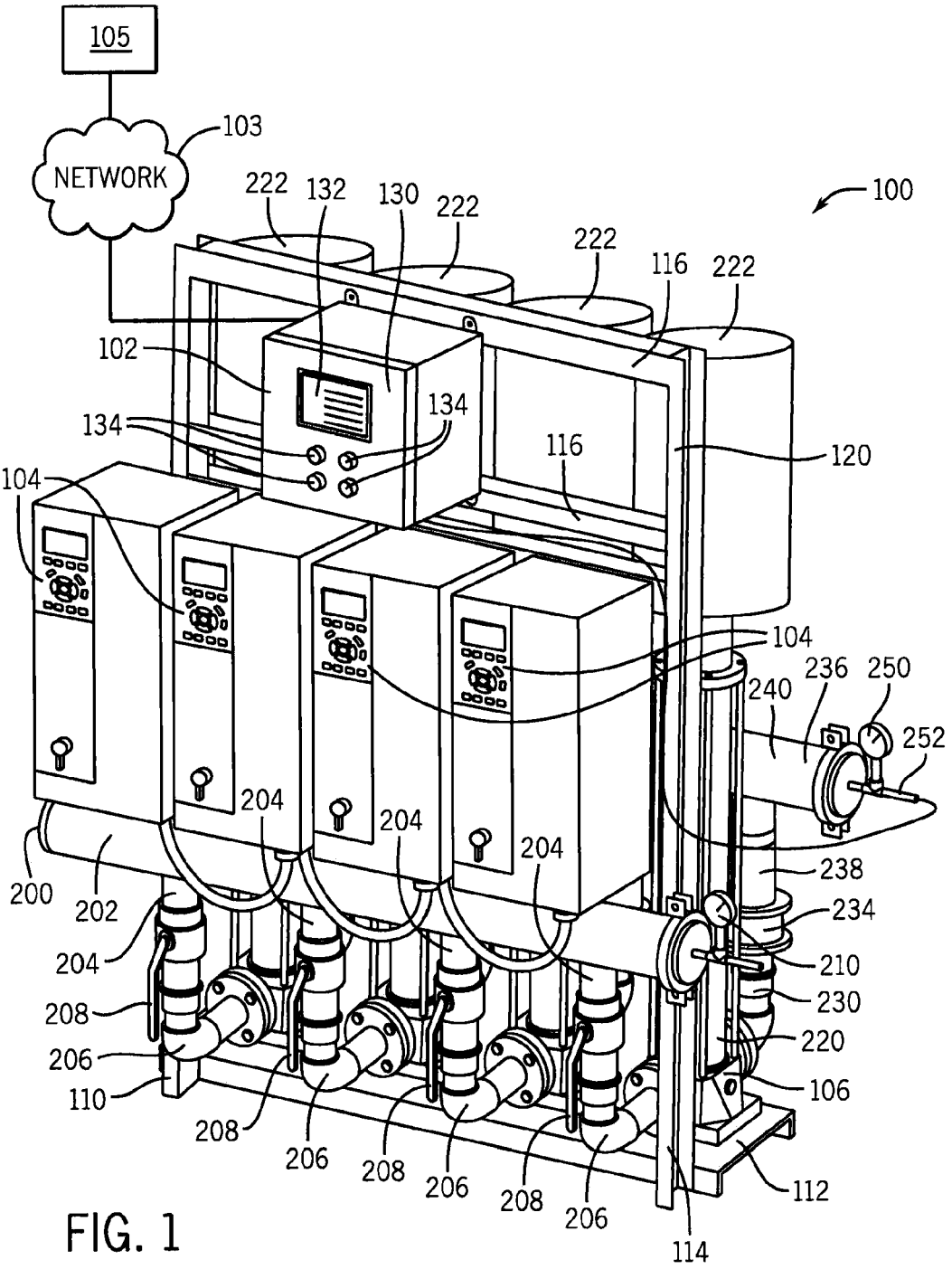
FIG. 1 is an isometric view of an embodiment of a water booster control system.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of embodiments of the disclosure.

Figure 2:
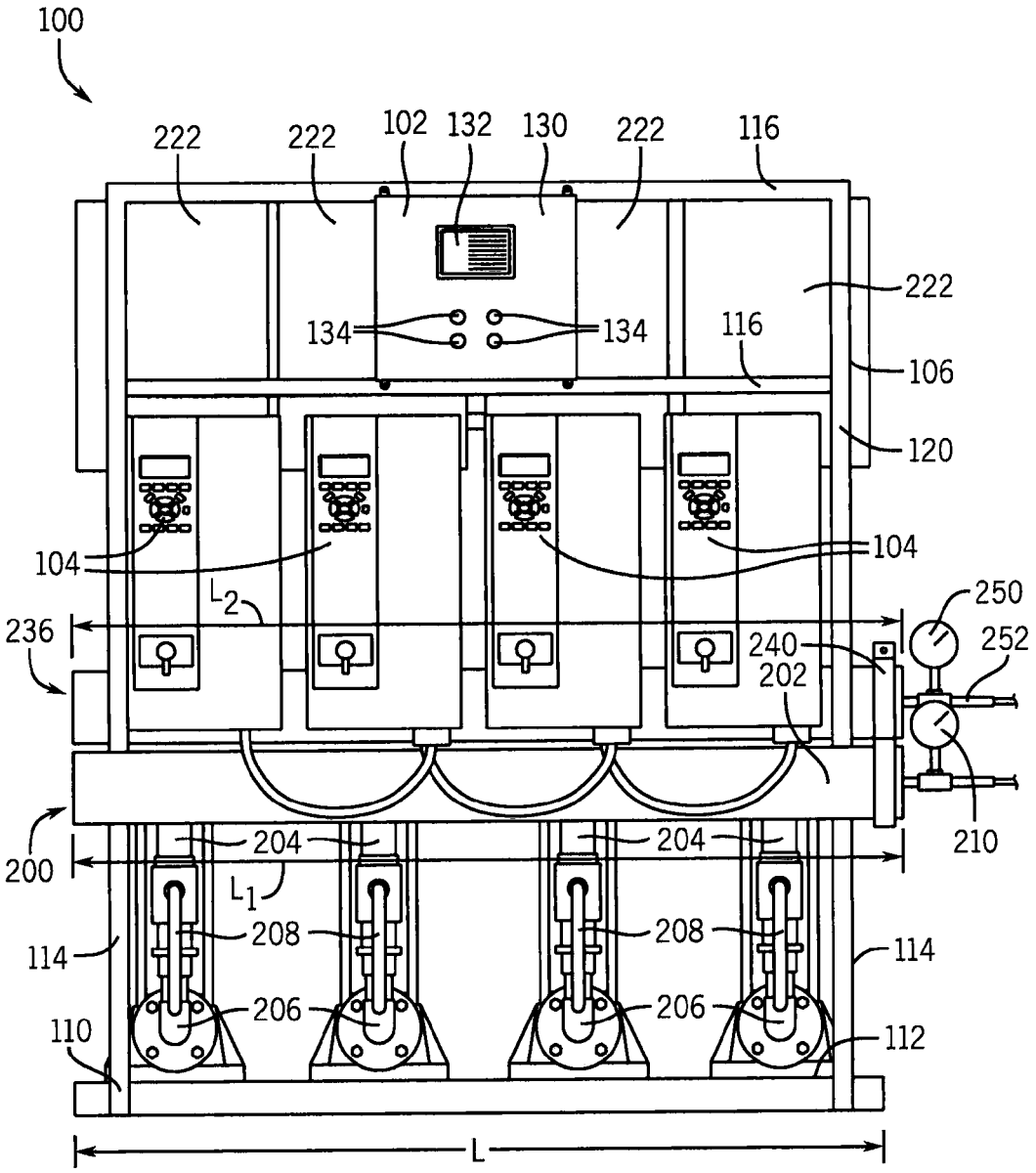
FIG. 2 is a front elevational view of the water booster control system of FIG. 1.
Figure 3:
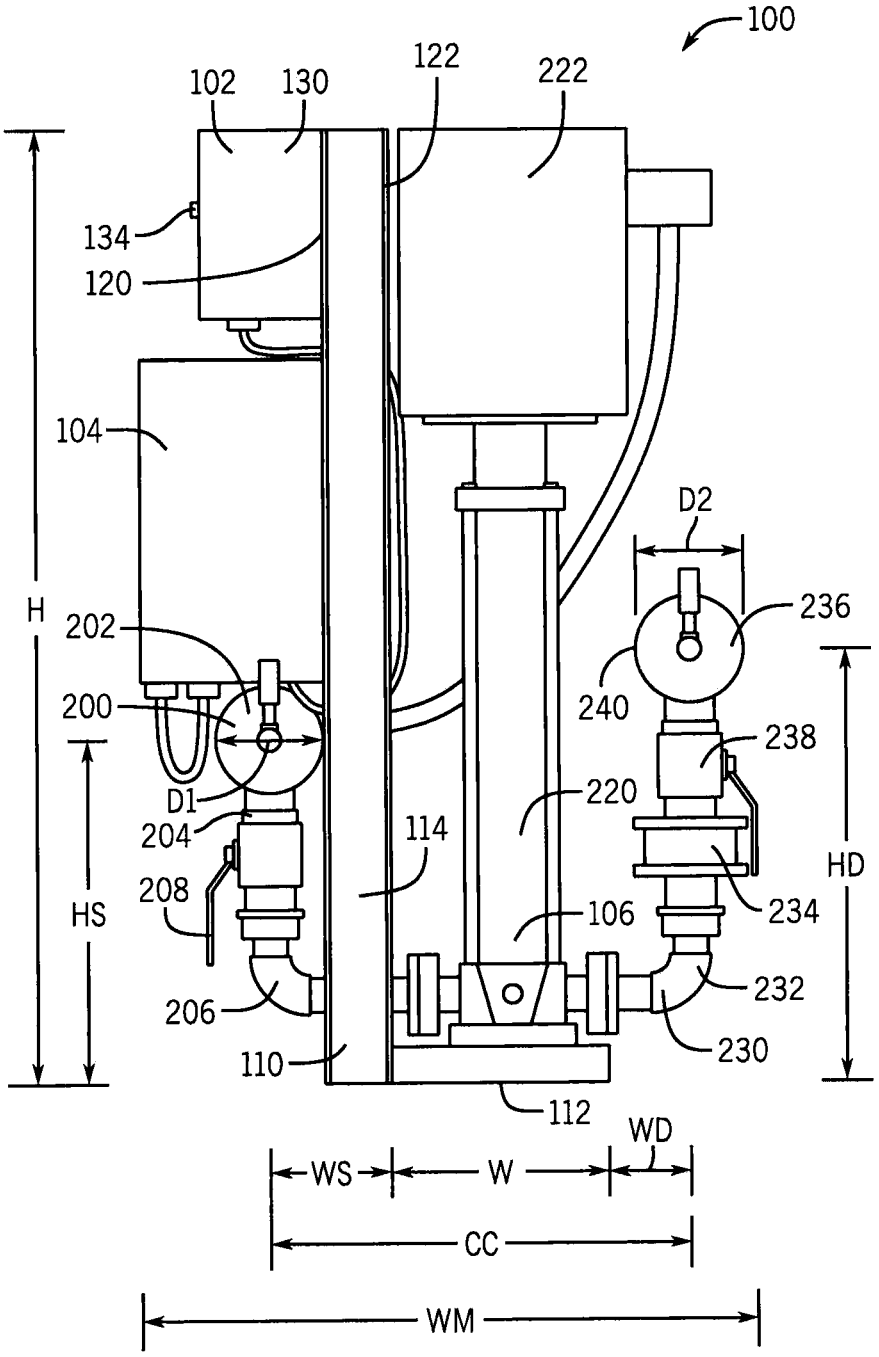
FIG. 3 is a side elevational view of the water booster control system of FIG. 1.

FIGS. 1-3 generally depict a water booster control system 100 that includes at least one controller 102 in communication with one or more drive units 104. The drive units 104 are operatively connected to one or more pumps 106 that are designed to move fluid at specified flow rates. The water booster control system 100 is designed to receive water (not shown) from an outside source via a pipe or other conduit (not shown). The water flows through the water booster control system 100 and is propelled via the pumps 106. The water booster control system 100 is generally designed to be used in fresh water applications in high rises, office buildings, hospitals, hotels, and other commercial, industrial, and municipal locations. However, the water booster control system 100 is not limited to the above applications. It is contemplated that that water booster control system 100 may be used in other applications, including, for example, salt water applications or residential locations.

The water booster control system 100 is supported by a frame 110 having a base plate 112 extending horizontally adjacent a surface (not shown). A plurality of support arms 114 protrude upwardly at ends of the base plate 112 and further include one or more cross-bars 116. The frame 110 is preferably made of steel to provide support to the entire water booster control system 100 and associated components, although the frame 110 may be made of other materials as known in the art. The frame 110 includes a length dimension L (see FIG. 2) that is between about 25 centimeters to about 200 centimeters, and more preferably between about 75 centimeters to about 150 centimeters. The length dimension L may be adjusted depending on the quantity of pumps 106 present in the water booster control system 100.

The base plate 112 of the frame 110 also includes a width dimension W (see FIG. 3) of between about 12 centimeters to about 75 centimeters, more preferably between about 25 centimeters to about 50 centimeters, and most preferably about 40 centimeters. The frame 110 further includes a height dimension H of between about 40 centimeters to about 250 centimeters, more preferably between about 175 centimeters to about 230 centimeters, and most preferably about 200 centimeters. It should be recognized that the length L dimension, width W dimension, and height H dimension of the frame 110 may be adjusted as desired.

Still referring to FIGS. 2 and 3, the frame 110 includes a front surface 120 and a rear surface 122 on an opposing side. The front surface 120 and rear surface 122 are each designed to support various components of the water booster control system 100. The components may be coupled or otherwise attached to the frame 110 in a manner so as to allow the water booster control system 100 to be located in an upright position without tipping. Additionally, the frame 110 may be secured to one or more of a wall, a floor, or other surface to further secure the water booster control system 100. Still further, one or more components of the water booster control system 100 may be used without being attached to the frame 110 and/or the frame 110 may be omitted all together.

The water booster control system 100 also includes a suction manifold 200 disposed on and attached to the front surface 120 of the frame 110. The suction manifold 200 is designed to be coupled to a water line (not shown) and receive water into the water booster control system 100 from a municipal or other water source. The suction manifold 200 is defined by a cylindrical conduit 202 that extends in an orientation parallel to the base plate 112 of the frame 110. In one specific embodiment, the length dimension $L_1$ of the conduit 202 is substantially the same as the length dimension L of the frame 110, as shown in FIG. 2. In a different embodiment, the length dimension $L_1$ of the conduit 202 is different from the length dimension L of the frame 110. The cylindrical conduit 202 of the suction manifold 200 includes a diameter dimension $D_1$ (see FIG. 3) that is between about 5 centimeters to about 15 centimeters, and more preferably between about 8 centimeters to about 10 centimeters. The suction manifold 200 is positioned at a height HS (see FIG. 3) as measured from the base plate 112 to the center of the conduit 202. The height HS of the suction manifold 200 is between about 12 centimeters to about 107 centimeters, and more preferably between about 91 centimeters to about 97 centimeters. Likewise, the suction manifold 200 is positioned at a width WS (see FIG. 3) as measured from the edge of the base plate 112 to the center of the conduit 202. The width WS of the suction manifold 200 is between about 18 centimeters to about 50 centimeters, and more preferably between about 20 centimeters to about 30 centimeters in order reduce the installation size of the water booster control system 100 in a mechanical pump room, for example. In some embodiments, the width WS may vary based upon the pump 106 selection necessary to achieve the desired flow and pressure of the water booster control system 100.

The conduit 202 is coupled to a plurality of pipes 204 extending downwardly. The pipes 204 each terminate at an elbow junction 206, which directs the orientation of the pipes 204 inwardly toward the front surface 120 of the frame 110. The pipes 204 are in fluid communication with one or more pumps 106. The pipes 204 may have a diameter (not shown) that is equal to or greater than diameter $D_1$ of the suction manifold 200. In one embodiment, a single pipe 204 is connected to each pump 106 as depicted in FIGS. 1-3. In a different embodiment, a single pipe 204 may supply more than one pump 106. In still a further embodiment, more than one pipe 204 may supply a single pump 106.

The pipes 204 may optionally include a valve 208 associated therewith. The valve 208 is designed to regulate and direct the water flowing from the suction manifold 200 through the pipes 204 and into the pumps 106. In one embodiment, the valve 208 is a full port ball valve. The full port ball valve is designed to minimize friction as water flows therethrough by utilizing a ball having an opening with a diameter that is approximately equal to the diameter of the pipe 204. In a different embodiment, the valve 208 is a reduced port valve. In a further embodiment, the valve 208 is a V-port valve.

The suction manifold 200 optionally includes a pressure gauge 210 that is designed to measure the pressure of water as the water enters the suction manifold 200. In particular, in one embodiment, the pressure gauge 210 measures the pressure inside of the suction manifold 200. In one embodiment, the pressure gauge 210 may be a liquid filled mounted gauge with an isolation valve that is supplied to the suction manifold 200.

As water enters into and flows through the suction manifold 200, the water is directed through the pipes 204 and associated valves 208 toward the pumps 106. As shown in FIG. 3, each pump 106 includes a base conduit 220 that extends upwardly into and terminates at a cylindrical head 222. Each pump 106 is operatively connected to a motor (not shown). The types of pumps 106 utilized in the water booster control system 100 may be tailored to the specific needs of the building. In one embodiment, the pumps 106 are vertical multi-stage pumps. A particularly useful vertical multi-stage pump is the AURORA® brand or FAIRBANKS NIJHUIS® PVM multi-stage pumps manufactured by Pentair. In one particular embodiment, the PVM multi-stage pumps include inverter suitable motors. In a different embodiment, a pump 106 useful for the water booster control system 100 is an end suction pump. In particular, a suitable end suction pump is the AURORA® or FAIRBANKS NIJHUIS® 3800 series single stage end suction pump manufactured by Pentair. One or more different types of pumps 106 may be used in the water booster control system 100.

The number of pumps 106 utilized in the water booster control system 100 may be varied according to the needs of the building. For example, the water booster control system 100 may only utilize a single pump 106. Alternatively, the water booster control system 100 may utilize two, three, four, or more pumps 106 as desired.

After water flows through the pumps 106 and is routed at the specified pressure, the water is sent through discharge pipes 230 that extend from the base conduit 220 of the pump 106 adjacent the rear surface 122 of the frame 110. The discharge pipes 230 protrude outwardly and curve upwardly at elbow joints 232. A check valve 234 is mounted to each discharge pipe 230 and is designed to allow water to flow in only one direction (i.e., toward a discharge manifold 236). Any check valve 234 known in the art may be suitable for use with the water booster control system 100. In one embodiment, a check valve 234 is mounted to and associated with each discharge pipe 230. In a different embodiment, a check valve 234 is mounted to and associated with at least one discharge pipe 230.

As shown in FIGS. 1 and 3, the check valves 234 are each coupled to a grooved manifold 238. In some embodiments, the manifold 238 may be a flanged manifold. The manifold 238 provides fluid communication between the check valve 234 and the discharge manifold 236 for water flowing through the water booster control system 100.

The water flows through the grooved manifold 238 into the discharge manifold 236, which is attached to the rear surface 122 of the frame 110. The discharge manifold 236 is defined by a cylindrical conduit 240 that extends in an orientation parallel to the base plate 112 of the frame 110. The discharge manifold 236 is designed to be in fluid communication with secondary local pipes (not shown) that direct water to one or more specific locations within the building.

In one embodiment, a length dimension $L_2$ (see FIG. 2) of the conduit 240 is substantially the same as the length dimension L of the frame 110, and/or the length $L_1$ of the suction manifold 200. In a different embodiment, the length dimension $L_2$ of the conduit 240 is different from the length dimension L of the frame 110 and/or the length $L_1$ of the suction manifold 200. The conduit 240 of the discharge manifold 236 includes a diameter dimension $D_2$ (see FIG. 3) that is selected based upon the flow capabilities of the chosen pumps 106 using the Hydraulic Institute standards as required for the specific use. The discharge manifold 236 is positioned at a height HD as measured from the base plate 112 to the center of the conduit 240. In some embodiments, the height HD of the discharge manifold 236 is between about 40 centimeters to about 90 centimeters. Likewise, the discharge manifold 236 is positioned at a width WD (see FIG. 3) as measured from the edge of the base plate 112 to the center of the conduit 240. The width WD of the discharge manifold 236 is between about 18 centimeters to about 40 centimeters, and more preferably between about 20 centimeters and to about 30 centimeters in order reduce the installation size of the water booster control system 100 in a mechanical pump room, for example. In some embodiments, the width WD may vary based upon the pump 106 selection necessary to achieve the desired flow and pressure of the water booster control system 100.

In some embodiments, the water booster control system 100 includes a maximum width dimension WM (see FIG. 3) that is measured from the edge of the housing 130 to the opposite edge of the conduit 240 of the discharge manifold 236. The maximum width dimension WM is between about 90 centimeters to about 140 centimeters. The water booster control system 100 may further include a center to center distance CC (see FIG. 3) as measured from the center of the suction manifold 200 conduit 202 to the center of the discharge manifold 236 conduit 240. The center to center distance CC is between about 70 centimeters to about 85 centimeters. The dimensions (e.g., WM and CC) of the embodiments of the water booster control system 100 may vary based upon the pump 106 selection to achieve the desired flow and pressure selected by the user. The standard dimensions may be based upon PVM and end suction pump minimal dimensions between the centers of the suction manifold 200 and the discharge manifold 236 to allow for access to the pump when maintenance is required.

The discharge manifold 236 optionally includes a pressure gauge 250. In particular, in one embodiment, the pressure gauge 250 measures the pressure inside the discharge manifold 236 downstream from the pumps 106. In one embodiment, the pressure gauge 250 may be a liquid filled mounted gauge with an isolation valve that is supplied to the discharge manifold 236.

As shown in FIG. 1, one or more transducers 252 are associated with the suction manifold 200 and/or the discharge manifold 236. The transducer 252 is designed to measure pressure and transmit the information to the controller 102, which may be a programmable logic controller (PLC), and shown on a screen 132. The transducer 252 provides the values of available pressure from the supply and the actual pressure of the system 100 to the PLC after boosting to ensure the desired pressure is achieved. In addition, the transducer 252 allows the user to determine alarm notification threshold, shutdown, and reset parameters. For example, the suction manifold 200 and/or discharge manifold 236 may be programmed to automatically shut down after a defined number of errors or faults over a defined timeframe. The transducer 252 may optionally be used in conjunction with a flow meter (not shown) to allow the user to select a desired flow in conjunction with pressure. The flow meter parameters may be selected during the start-up sequence of the water booster control system 100. The flow meter may be installed in the discharge manifold 236 at the factory or during installation onsite, for example. In one embodiment, a flow meter suitable for use is the Badger® Series 200 insertion flow meter made by Badger Meter, Inc. (Milwaukee, Wis.).

Referring again to FIGS. 1-3, the water booster control system 100 further includes the controller 102, which determines and directs all of the operational parameters of the water booster control system 100 including, for example, controlling the pressure, the flow rate, the suction and discharge parameters, the pump parameters, etc. In the embodiment depicted in FIGS. 1-3, the controller 102 and associated components are retained within a substantially square housing 130 that is supported by one of the cross-bars 116 on the front surface 120 of the frame 110. The housing 130 includes the screen 132 and a plurality of buttons 134 and/or switches disposed on a front surface. In an alternative embodiment, the controller 102 and associated components may be supported on the rear surface 122 of the frame 110 or any suitable location to allow a user to interact with the screen 132 of the controller 102.

The controller 102 is in communication with one or more drive units 104. The drive units 104 may be variable frequency drives (VFDs), which are characterized by a drive controller assembly, a drive operator interface, and an alternating current motor. The normal operation of the controller 102 and/or the staging of the pumps 106 is provided by an independent processor. The drive units 104 act as a signal follower in that the drive units 104 do not independently control the speed of the pumps 106. Rather, the drive units 104 simply execute commands sent from the controller 102 and send the correct frequency to the motors of the pumps 106. In the event of a system failure, the drive units 104 may send commands to the pumps 106 when the water booster control system 100 is operating in a manual mode.

In one particular embodiment, the controller 102 and the drive units 104 are configured in a master/slave relationship using a Modbus remote terminal unit (Modbus RTU) communication protocol. The Modbus RTU protocol utilizes serial communication and includes a redundancy check to ensure the accuracy of data. The drive units 104 each share the same parameters. The VFDs may include one or more keypads (not shown) which may be used to download parameters to the drive units 104. The VFDs may also have the capability to copy parameters to be stored within the keypad to be downloaded to another VFD that requires the identical parameters.

In another embodiment, the controller 102 and the drive units 104 may be configured using other master/slave protocols including, for example, Modbus TCP/IP, BacNET, Ethernet IP, etc. In one embodiment, one drive unit 104 is preferably associated with each pump 106. In other embodiments, one drive unit 104 may be in communication with more than one pump 106. In still a different embodiment, one drive unit 104 may be configured to be used with the entire water booster control system 100.

The controller 102 preferably includes a local user interface. Additionally, the controller 102 may include a remote user interface that is accessible via numerous communication mechanisms. In one specific embodiment, the local user interface is defined by a touch-screen display terminal that is designed to receive data via direct or indirect touching (e.g., through the finger of a user, a stylus, or the like). In some embodiments, the touch-screen display terminal is defined by the screen 132 having a 256K color display. One suitable touch-screen display terminal includes a human machine interface (HMI) panel. The touch-screen display terminal may also be defined by a black and white display, and/or may utilize other resolutions. In some embodiments, the touch-screen display terminal is defined by a height dimension of about 9 centimeters and a length dimension of about 15 centimeters, although it should be appreciated that the length and height dimensions of the touch screen display terminal may be any desired height and length. In another embodiment, the local user interface is defined by a screen operatively connected to a keyboard and/or a mouse (not shown).

The water booster control system 100 is also in communication with a power source (not shown). The controller 102 includes a switch to control power supplied to the water booster control system 100. In one embodiment, the switch is one of the buttons 134 extending from the housing 130. In a different embodiment, the power is controlled using other mechanisms and/or switches.

In some embodiments, the water booster control system 100 is optionally connected to a computer (not shown) or other network. For example, in one embodiment as shown in FIG. 1, the controller 102 is in communication with a network 103 via an Ethernet connection. The Ethernet connection may allow a distributor, factory, maintenance personnel, or other authorized individuals to interact with the controller 102 from a remote device 105. The network 103 may be a local or wide, wired or wireless network, for example, that includes the Internet to allow the remote device 105 to access the controller 102. In some embodiments, the remote device 105 may be a networked workstation, a computer, a laptop, a smart phone, a handheld tablet, or another electronic device, for example.

The controller 102 is preferably a programmable logic controller (PLC) that includes a processor that facilitates the operation of the water booster control system 100 and staging and sequencing of the pumps 106. The controller 102 is defined by a proportional integral derivative (PID) loop that controls various operational parameters by determining the difference between a set process variable (e.g., actual pressure) and a desired set point (e.g., desired pressure). An error value is calculated as a result of the difference between the actual flow and the desired flow, and is used to adjust the input parameters to continually attempt to minimize the error value, and thus, tune the parameters. Three constant variables are present in the PID calculation including the proportional, integral, and derivative values, which are commonly related to the present error, past errors, and future errors, respectively. Based on the PID calculations, the controller 102 sends commands to the water booster control system 100 to perform specific actions to adjust the operational parameters.

Numerous features of the controller 102 allow for customization. For example, in one embodiment, the pump operational sequence may be selected without reprogramming the controller 102. The selection may be completed while the pumps 106 are in service and may be adjusted in real time as changes occur onsite that require the adjustment of the pump 106 sequencing or operating parameters. In another embodiment, maintenance alarm thresholds may be defined by the user.

The controller 102 optionally includes an auto-detect functionality that automatically adjusts the pumps 106 start/stop times and/or other parameters to maximize the efficiency of the water booster control system 100. The increased efficiency increases the life of the pumps 106. In particular, the auto-detect functionality automatically adjusts the start/stop functions of the drive units 104 to meet changing conditions onsite. An algorithm is used to set the specified start/stop functions of the drive units 104 using input variables such as pressure, flow, and the ampere draw of the motor, which is the measurement of electrical current measured from the motor while the (pump) motor is being operated. During an "in use" cycle, each pump 106 ramps up via its motor to provide the specified flow. Once the desired flow is reached, the pump 106 is no longer effective. The point at which the pump 106 has provided the specified output (i.e., flow) is recorded and is used to start the pump 106 during the subsequent "in use" cycle. In one specific embodiment, the pump 106 is started during the subsequent "in use" cycle at a point where the pump 106 is functioning to move water.

In some embodiments, the ramp speed may vary to inhibit the VFD from fault conditions that will cause the water booster control system 100 to alarm. VFD faults, such as overcurrent and over torque, may be avoided by factory predetermined ramp speeds. Variable ramp speeds may reduce the need for hydro-pneumatic tanks that are traditionally installed on the discharge manifold of conventional water booster control systems. In traditional VFD driven water booster control systems, the ramp speeds are set at the startup of the "in use" cycle for a predetermined time period (e.g., a predetermined number of seconds). The predetermined time period may be adequate for normal job site conditions that demand water usage. However, if the water is demanded for a greater amount of time than the predetermined time period, and the ramp time is set to the same predetermined time period, the installed water booster control system may take too much time to meet the required pressure. This situation causes other devices in the water booster control system, such as components that require a minimum PSI, to not operate. For example, in some embodiments, a bladder tank placed on the discharge manifold is set with a mechanical pressure reducing valve to a desired pressure setting. Thus, any pressure drop experienced by the system requires the bladder tank to supply the pressure required. However, the bladder tank is limited by its size to the amount of pressure the tank can supply.

Therefore, the variable ramp speeds incorporated into the water booster control system 100 of the present disclosure allow the pumps 106 to achieve the set pressure in the most efficient time without over-pressurizing the water pipes. For example, if the set pressure is 690 kPa, and the demand suddenly reduces the installations pressure to 345 kPa, the water booster control system 100 can increase the ramp speed in proportion to the differential. In some embodiments, the minimum and maximum ramp speed may be programmed at the factory based on performance testing of each of the pump's 106 current at a minimum flow rate (measured in hertz (Hz)), duty conditions (measured in Hz), and maximum flow rate (e.g., 50-60 Hz). The ramp speeds are varied based upon a delta of the set pressure versus the actual pressure. If the water booster control system 100 receives a sudden demand for pressure, the proper ramp speed to achieve this demand may be determined by the preset ramp speeds programmed at the factory during the performance testing. As the pumps 106 approach the set pressure desired, a second ramp speed may be utilized. The second ramp speed helps inhibit the pumps 106 from exceeding the desired set pressure and reduced water hammer.

Figure 4:
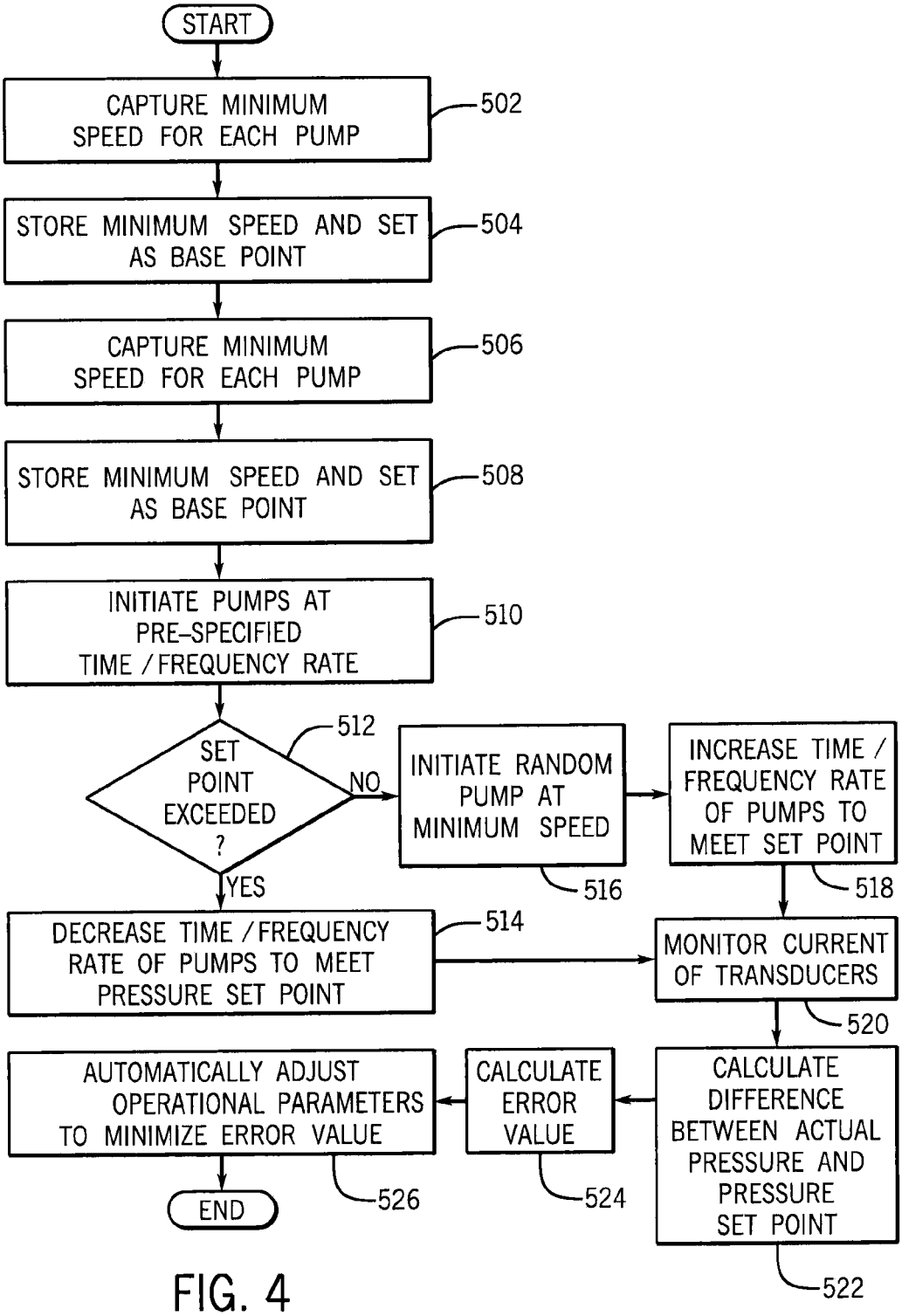
FIG. 4 is a flow chart setting forth a plurality of steps of a process for determining at least one pump parameter using an algorithm.

Referring now to FIG. 4, a flow chart setting forth exemplary steps 500 for determining at least one pump 106 parameter using the algorithm is provided. In one embodiment, the algorithm controls the speed of the pumps 106 to operate at the most efficient location within each pumps 106 hydraulic curve based upon outside parameters that are constantly changing (e.g., suction pressure, demand discharge pressure, flow, etc.). To start the process, the minimum speed for at least one pump 106 is captured at process block 502. In some embodiments, the minimum speed of more than one pump 106 (e.g., two, three, four, or more pumps) is captured. In some embodiments, the minimum speed may be defined as the speed at which each pump 106 can produce flow or increase pressure above the incoming pressure to the water booster control system 100. The minimum speed captured for each pump 106 at process block 502 is stored by the controller 102 and utilized as a base point for operation at process block 504 of the water booster control system 100.

Similarly, at process block 506, the algorithm also captures the maximum speed of at least one pump 106. In some embodiments, the maximum speed of more than one pump 106 (e.g., two, three, four, or more pumps) is captured. In some embodiments, the maximum speed may be defined as the speed that each pump 106 can operate at without allowing the drive units 104 to experience an overcurrent to prevent shutdown of the water booster control system 100. Overcurrent is a common issue that occurs in water booster control systems when pumps are incorrectly sized for the building conditions. For example, if a larger than intended electric current exists through a conductor, leading to excessive generation of heat, the risk of fire or damage to equipment is possible due to the excessive load and/or incorrect design. Once the maximum speed for each pump 106 is captured at process block 506, the maximum speeds are stored by the controller 102 and utilized as a base point for operating at process block 508.

In an alternative embodiment, the minimum and maximum speed for each pump 106 may be set at the factory based upon the minimum continuous stable flow (MCSF) and maximum amperage allowable to each VFD based upon the desired duty conditions of the water booster control system 100. The MCSF and maximum amperage are determined by flow testing of each pump 106 at the factory's UL Certified Laboratory that requires calibrated watt meters, flow meters, and pressure gauges. In addition, minimum speeds may be obtained by calculating the specific speeds of each pump 106 during an "in use" cycle of the water booster control system 100. The differential of the suction and discharge transducers 252 may be measured to determine if the factory set minimum speed will change pressure values. If the differential pressure values change at the minimum speed, then the controller 102 can reduce the speed further until the differential pressure values no longer change. The specific speed may be calculated by first multiplying the pump 106 shaft rotational speed (i.e., revolutions per minute (RPM)) by the flow rate (e.g., liters/minute). The resulting value is then divided by the total dynamic head (TDH) of the pump 106, which may be measured in meters, for example. TDH is the total equivalent height that a fluid is to be pumped, taking into account friction losses in the system. Once the specific speeds of each pump 106 have been measured and recorded over time, the minimum and maximum speeds of the pump 106 can be determined.

Once the initial settings are captured (i.e., the minimum and maximum speed of each pump 106) and stored, the algorithm will command the pump(s) 106 to meet the demand of the water booster control system 100 at a specified time/frequency rate at process block 510. At decision block 512, the algorithm determines if a set point is exceeded based on the pump(s) 106 being initiated at the pre-specified time/frequency rate. If the set point is exceeded at decision block 512, the controller 102 will then decrease the time/frequency rate of the pumps 106 until the set point is met at process block 514. However, if the set point is not exceeded at decision block 512, which indicates that no pressure loss is detected after an adjustable time period, one random pump 106 will turn on at the minimum speed setting and ramp at the predetermined rate of time at process block 516. The ramp time may vary depending on the differential of the actual pressure measures versus the set point. Initiating one random pump 106 at the minimum speed setting will determine, by measuring the changes in the system flow rate, if there are small demands (e.g., low flow changes) in the water booster control system 100. Then at process block 518, the controller will increase the time/frequency rate of the pump 106 to meet the set point and prepare the VFD for a faster ramp time than the previous setting.

At process block 520, the program continues to monitor the current from one or more transducers 252 to meet the demand set point. At process block 522, the system will calculate the difference between the actual pressure and the pressure set point, and based on the calculated difference, an error value may be calculated at process block 524. Thus, depending on the distance from the demand set point and the actual pressure point, the system will automatically adjust the input and operational parameters. For example, the speed of each pump 100 may be adjusted to meet the demanded pressure and flow in order to minimize the error value at process block 526. Additionally, depending on the systems demand, either small or large, the water booster control system 100 will react at the appropriate speed and reduce water hammer while using the appropriate amount of power (measured in kilowatts (kW)). In an alternative embodiment, rather than automatically adjusting the operational parameters based upon the varying pressure demands, the water booster control system 100 may start at a fixed minimum speed in which no flow or pressure is generated until the system 100 ramps at a preset speed to the RPMs necessary to achieve the set point. Alternatively, to achieve the necessary pressure demand, the pumps 106 may ramp too quickly and may exceed the pressure setting, thus exceeding the set pressure which may require the installation on pressure reducing valves (PRV) in order to prevent pipe and component damage.

Additionally, at process block 526, the system may automatically adjust operational parameters, such that when the demand increases above the capability of a single pump 106, additional pumps 106 will be engaged. When the desired set point is reached in pressure or flow, the operating pumps 106 will then match speeds to operate at the most efficient area in the curve. If the speed of the matched pumps 106 falls below a set point in which no flow or pressure is gained, then one pump will drop off and will start the same matching process with the remaining pumps until only one pump 106 is running. When this last pump speed is reduced to a set point, the pump 106 will shut down and continue to monitor the installation until a demand is received from the systems transducers 252.

The controller 102 also optionally includes one or more maintenance alarms, which are designed to provide notification to the water booster control system 100 operator. The maintenance alarm thresholds may be defined by the user and are designed to monitor one or more of the pumps 106, the drive units 104, motors, transducers, and the controller 102. The notifications may be transmitted to the operator in a variety of ways. For example, in one embodiment, the notifications are transmitted locally via a visual and/or audible alarm associated with the screen 132. In another embodiment, the notifications are transmitted to the remote device 105 of the operator via the network 103, as shown in FIG. 1, which may be a data and/or voice network. In a particular embodiment, the notifications are transmitted to the remote device 105 of the operator through the network 103, which may be a wireless network. In another embodiment, the notifications are transmitted from the water booster control system 100 through a wired cable to the network 103. The notifications may then be routed to the remote device 105, such as a personal computer, telephone, or other device. The notifications are particularly advantageous as they allow the operator to access and receive information about a possible maintenance situation remotely. In particular, the operator may review the notifications and determine if immediate maintenance and/or attention is required, or determine whether the notification is a non-emergency.

Additional options that may be selected through the controller 102 include viewing of each specific VFD operating condition and allowing the user to operate the pump in "hand" or manual speed. This allows the user to view VFD information including, but not limited to, operating temperature, output power, frequency, and alarm/fault conditions. This also allows the user to operate the pump 106 at a desired set speed, which is performed during a test or to check proper pump 106 rotation. If a fault condition is triggered within the VFD, the operator can reset the specific faulted VFD at the water booster control system 100 by pressing a reset button. In an alternative embodiment, the operator view VFD operating conditions or perform a reset by reviewing a VFD manual to navigate through a VFD keypad.

Figure 5:
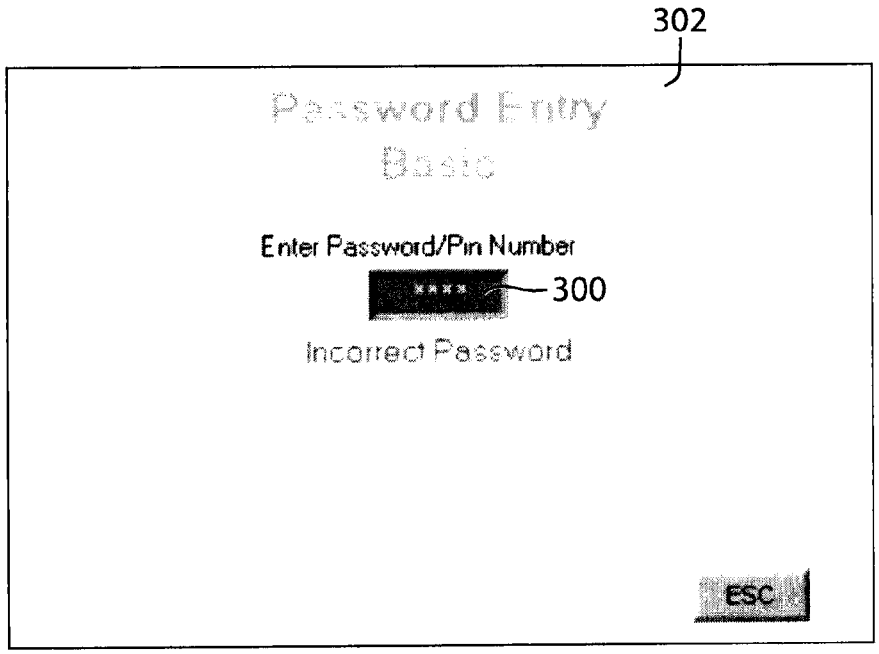
FIG. 5 is schematic representation of a security screen used in the water booster control system of FIG. 1.

In use, an operator turns the water booster control system 100 on using a switch or other mechanism. During a setup operation, the operator enters various operating parameters into the water booster control system 100 via the screen 132, which in some embodiments is a touch screen terminal. As depicted in FIG. 5, a user may be required to enter a password 300 into a security screen 302. The security screen 302 prevents unauthorized personnel from reconfiguring the water booster control system 100 settings. One or more security profiles may be customized to allow various persons different viewing and/or editing capabilities.

After entering a verified (e.g., correct) password, one or more setup and/or operational screens (see e.g., FIGS. 6-13) are displayed to the user. For example, the user may be required to enter various settings relating to the controller 102. In particular, the user may be required to select the type of control desired (e.g., discharge or flow) and the related set point (e.g., pressure or volumetric flow rate). The set point is the system PSI/GPM at the output of the water booster control system 100 that is maintained. The user may be further required to define the number of pumps 106 that are to be operated by the controller 102 and utilized with the water booster control system 100. Additionally, the user may be required to select a level for the pump controller's response to system changes. In one embodiment, the user may select high, medium, or low for desired response for the water booster control system 100 demand. High system demands (i.e., quick flow changes) may be set to high, and low system demands (i.e., low flow changes) may be set to low. For normal operations, the user may set the desired response to medium.

Figure 6:
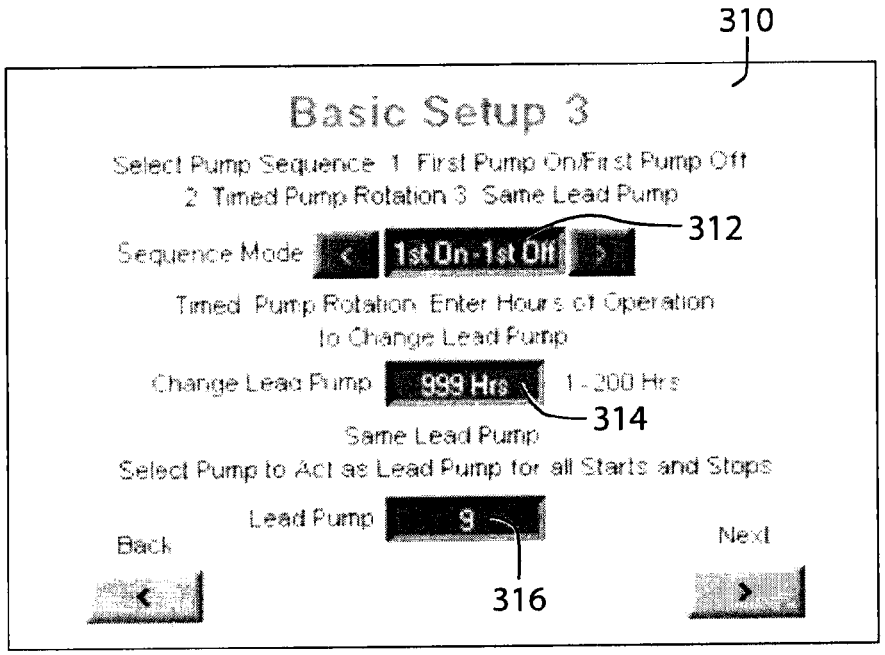
FIG. 6 is a schematic representation of a pump setup screen used in the water booster control system of FIG. 1.

One particular setup screen is depicted in FIG. 6, which shows a pump setup screen having numerous user input fields including a pump sequence mode selection 312, a pump rotation selection 314, and a lead pump selection 316. The pump selection screen 310 may be viewed and/or edited while the pumps 106 are in service and allows the user to select an appropriate pump sequence without specialized PLC programming or purchasing a different controller 102. The pump sequence is characterized by the user's ability to select a lead pump (i.e., the first pump that is turned on) and a lag pump (other pumps that follow the lead pump).

The user has the ability to select first on/first off from the pump sequence selection 312, which means that the pump 106 defined as the lead pump is rotated during each startup cycle. In particular, the lead pump rotates to the next pump in the sequence if only one pump is started during the cycle. If more than one pump has been started, then the pump that started second is the new lead pump. The old lead pump is the first pump to be turned off and the new lead pump (second lead pump) is the last pump on in a new start cycle. Finally, the second lead pump is the next pump in the sequence.

If the user chooses the timed pump rotation selection 314, the lead pump changes to another pump when an hours parameter times out and the lag pumps turn off and on as needed. The lag pumps operate in a sequence in which the first lag pump on is the first lag pump off. If the user chooses the same lead pump selection 316, the same lead pump is utilized for each cycle. The lag pumps (non-lead pumps) turn off and on as needed. The lag pumps operate in a sequence in which the first lag pump on is the first lag pump off.

Figure 7:
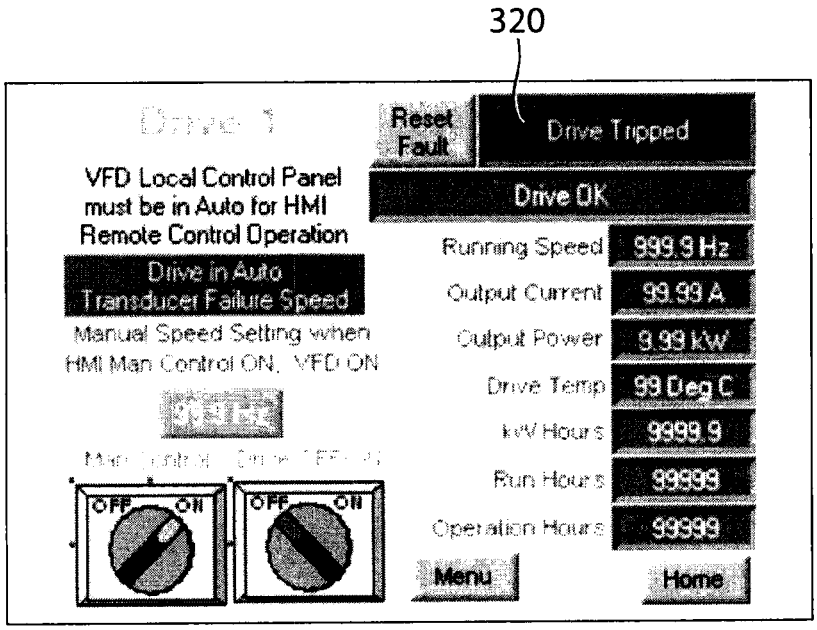
FIG. 7 is a schematic representation of a drive information screen used in the water booster control system of FIG. 1.
Figure 8:
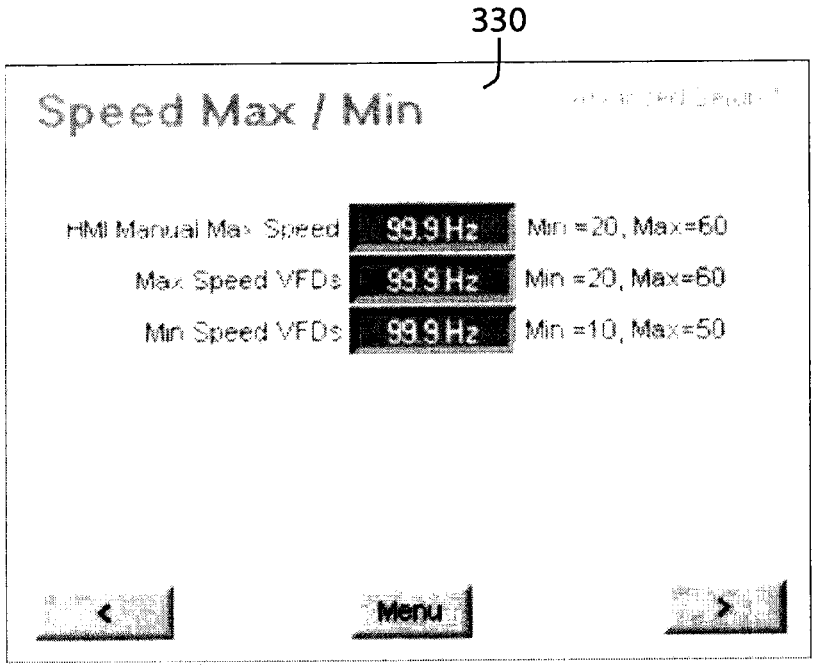
FIG. 8 is a schematic representation of a drive setup screen used in the water booster control system of FIG. 1.

FIGS. 7 and 8 illustrate setup screens relating to the drive units 104. In FIG. 7, a drive information screen 320 is shown that displays real-time information relating to at least one of the drive units 104. For example, information relating to the running speed, output current, output power, drive temperature, power per hour, the run hours, and the time the drive has been in operation are depicted. One or more drive information screens 320 may be created for each drive unit 104 in operation in the water booster control system 100. Similarly, FIG. 8 shows a drive setup screen 330, which allows the user to select a maximum and a minimum speed in which the drive unit 104 can operate when the water booster control system 100 is operating in either an auto-detect or manual mode in which the user can define specific minimum and maximum speeds of the pumps 106.

Figure 9:
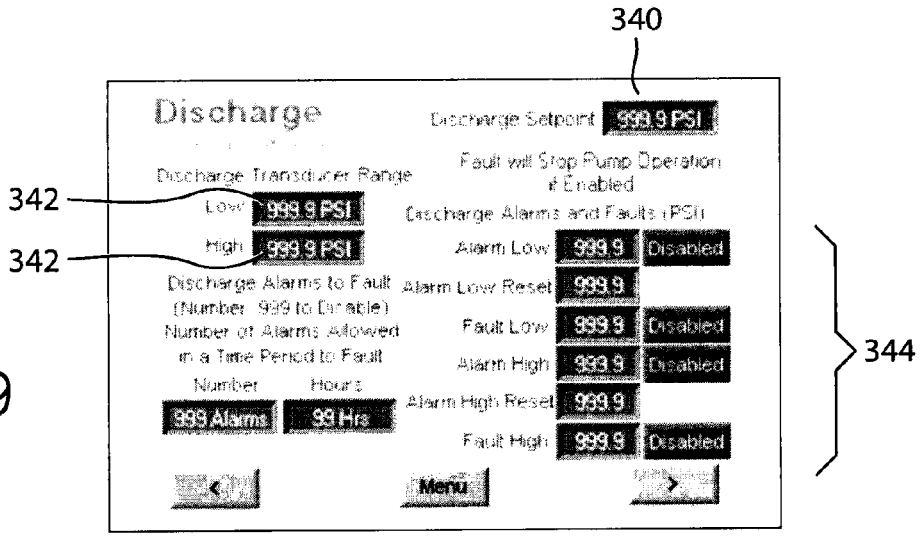
FIG. 9 is a schematic representation of a discharge transducer setup screen used in the water booster control system of FIG. 1.
Figure 10:
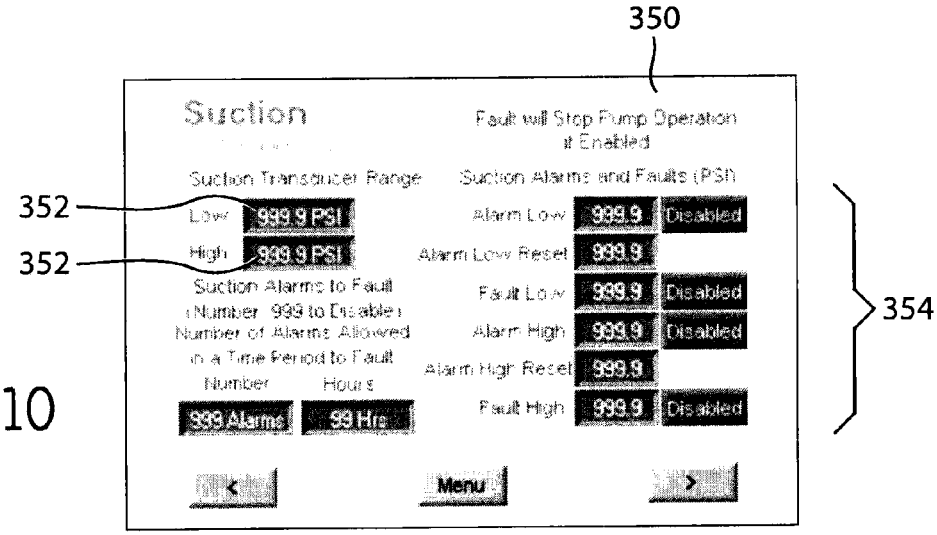
FIG. 10 is a schematic representation of a suction input setup screen used in the water booster control system of FIG. 1.
Figure 11:
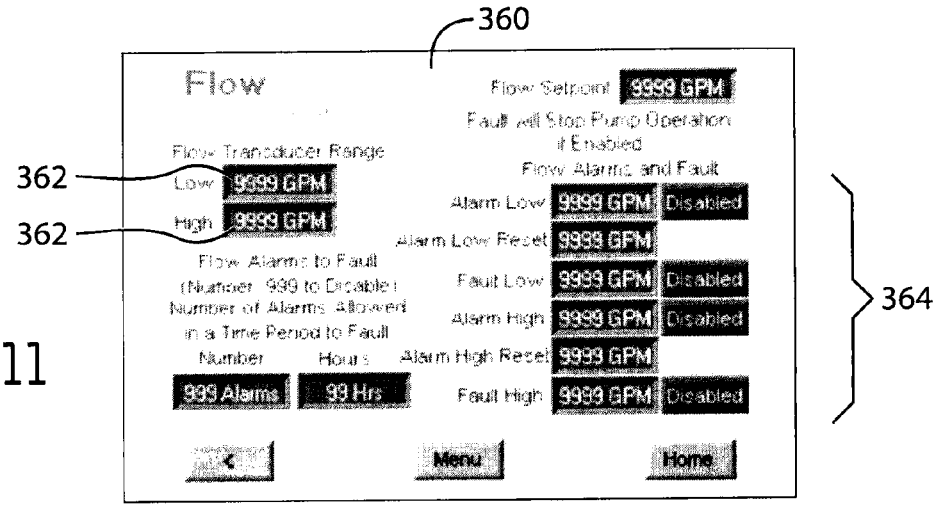
FIG. 11 is a schematic representation of a flow input setup screen used in the water booster control system of FIG. 1.

FIGS. 9-11 show various input screens associated with one or more transducers 252. As shown in FIG. 9, a discharge transducer setup screen 340 includes a pressure input 342 and numerous related alarms 344. FIG. 10 depicts a suction input setup screen 350 that includes a pressure input 352 and related alarms 354. Similarly, FIG. 11 shows a flow input setup screen 360 that includes a flow rate input 362 and related alarms 364.

The pressure inputs 342, 352, include threshold entries for both the maximum and minimum pressure desired. The flow rate input 362 includes threshold entries for the low and high flow rates desired. If the threshold entries are breached, one or more of the alarms 344, 354, 364 are designed to alert the user. The alarms may be programmed in a variety of ways. For example, a specified number of alarms activated per alarm setting in a specified number of hours may cause the system to enter a fault condition and the pumps 106 may cease operation. Further, the alarms may warn of conditions that are harmful or undesirable for the water booster control system 100. The alarms may auto-reset when the water booster control system 100 returns to a normal operating condition. In some embodiments, the fault conditions should be reset manually through the water booster control system 100 once the fault trigger is no longer evident.

FIGS. 12 and 13 illustrate two preventative maintenance alarm display and input screens 370, 380 that provide an overview of the selected alarm conditions present in the water booster control system 100 and allow the user to make adjustments. The maintenance alarms are designed to monitor one or more of the pumps 106, drive units 104, transducers 252, and controller 102. For example, FIG. 12 shows the operating condition of the pumps 106 including the number of starts, the pump hours in operation, the motor hours in operation, and the drive unit 104 hours in operation, and other related parameters. Similarly, FIG. 13 depicts the operating condition of one or more transducers 252 including pressure transducer hours, flow transducer hours, and PLC hours, and the related defaults.

Figure 14:
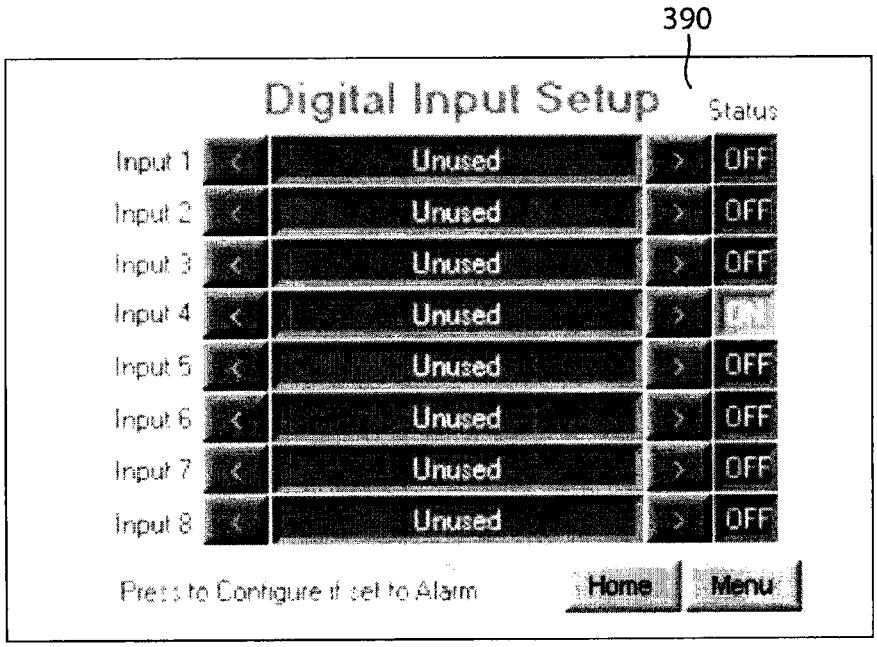
FIG. 14 is a schematic representation of an alarm setup screen used in the water booster control system of FIG. 1.
Figure 15:
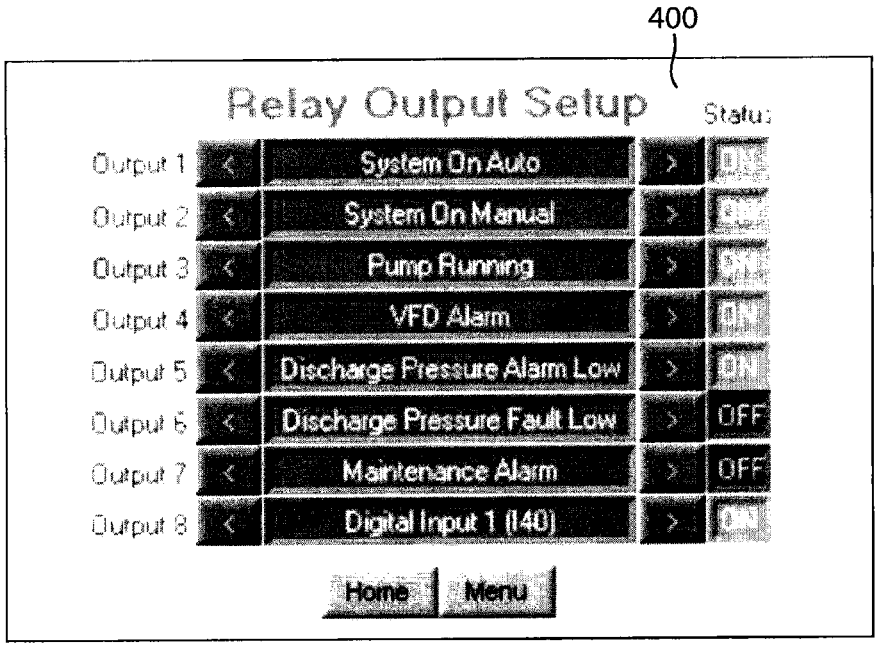
FIG. 15 is a schematic representation of another alarm setup screen used in the water booster control system of FIG. 1.

FIGS. 14 and 15 illustrate input alarm screens 390, 400 that allow the user to create various customized alarms. One or more alarms may be created for use when the water booster control system 100 is operating in an automatic condition or a manual condition. The alarms may be configured to alert the user of various operating conditions including, for example, an alarm indicating whether the one or more pumps 106 are running, an alarm indicating the discharge pressure of the water exiting the water booster control system 100 is too high or too low, an alarm indicating the suction pressure is too high or too low, an alarm indicating the drive units 104 are not operating properly, and an alarm indicating a fault condition has been triggered with any one of the discharge pressure, the suction pressure, and/or the flow rate.

Any of the aforementioned input or display screens may be transmitted to the user locally via the screen 132, remotely via a smart phone application, and/or via other suitable communication methods. For example, one or more of the maintenance alarm display and input screens 370, 380 may be transmitted to the user remotely to allow the user to assess a potential maintenance situation and determine its severity. The maintenance alarms allow a user or remote viewer to schedule component replacement before failure and end of life occurs. The alarms and faults also allow a user to diagnose the water booster control system 100 to determine the possible cause of the triggered alarm/fault. Thus, the remote and/or local user can determine the proper actions to replace or repair specific components of the water booster control system 100.

The operational screens shown in FIGS. 5-15 may be configured and manipulated by the user in different ways. For example, the operational screens may be displayed in any order suitable to allow the user to enter the necessary input and operational parameters. In addition, the operational screens may omit some information, include additional information, or have the information rearranged on the screen. For example, the input alarm screen 390 shown in FIG. 14 may include up to eight digital inputs, as shown, or alternatively include fewer than eight digital inputs. These selectable digital inputs are received from other devices to indicate alarm, fault, reset or change a relay output contact to control other accessory devices located in or near a mechanical pump room, for example. In some embodiment, one or more alarm conditions may be predefined. In a further embodiment, one or more alarms may be customized by the user. In a different embodiment, one or more alarms are predefined and one or more alarms are customized by the user. Thus, the different operational screens described above are not limited in their configuration and/or how the user interacts with the different screens.

In use, the water booster control system 100 is designed to supply water to a location at specified operating parameters. The user enters one or more system parameters and the system monitors the parameters and makes adjustments if the system is running in automatic mode. Alternatively, the water booster control system 100 may be operated in manual mode or via manual override of the automatic mode. In either mode, water enters the suction manifold 200, travels through the pipes 204, and into the pumps 106. The pumps 106 accelerate the water to the desired pressure and/or flow rate and discharge the water through pipes 230 and out of the discharge manifold 236. One or more of the components of the water booster control system 100 are monitored during use, and data regarding the parameters is displayed locally and/or remotely. Alarms may be specified relating to one or more of the operating parameters and the alarm conditions may be displayed locally and/or remotely. A user may make modifications to the system locally and/or remotely through the screen 132 and/or through the remote device 105 using a smart phone application.

One or more of the inputted operating parameters (i.e., decisions made to operate the system, not the ladder logic itself) that are in PLC, may be stored on a secure digital (SD) memory card, which may be utilized with the water booster control system 100. In particular, the parameters may be defined and saved on the SD card by the manufacturer, and sent to the customer for loading. The user can save the installed operating parameters that can then be loaded into the controller 102. The operating parameters loaded into the controller can be used to restore the controller 102 due to unintended changes by operator, or allow alternative parameters to be utilized. In addition, the user may have the ability download the original factory parameters from the SD card into the PLC.

Various components of the water booster control system 100 including the suction manifold 200, pipes 204, 230, and/or discharge manifold 236 are preferably made out of stainless steel. The components may also be made out of other materials such as, for example, other metals, alloys, polymers, and any other suitable material. For example, in one embodiment, one or more of the components of the water booster control system 100 are made of cast iron. Any of the components of the water booster control system 100 may be made from a hydrophilic or hydrophobic material, and/or include a hydrophilic or hydrophobic coating. The hydrophilic and/or hydrophobic coating may act to facilitate water flow through the water booster control system 100. Other coatings may also be used including rust inhibitors, anti-bacterial agents, etc.

The water booster control system 100 may optionally include other components, such as a flow meter, a hydro pneumatic tank, a single power distribution panel, etc.

It will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

The invention claimed is:

1. A water control booster system, comprising:

a pump in communication with a drive unit;

a user interface; and a controller in communication with the pump and the drive unit, the controller designed to control at least one operating parameter of the pump, wherein the controller further includes a processor and memory storing an algorithm stored thereon that is designed to determine the at least one operating parameter of the pump, wherein the at least one operating parameter is one of a pump sequence mode, a pump rotation, a lead pump, and a lag pump, and the water booster control system is further designed to allow a user to enter at least one customizable alarm threshold through the user interface the processor comparing the at least one operating parameter with the alarm threshold and transmitting a notification to the user remotely when the threshold is breached;

wherein the algorithm is configured to carry out the steps of:

determining a set point defined by at least one of a system pressure and a system flow for which the water control booster system demands;

capturing at least one of a minimum speed and a maximum speed of the pump;

storing the at least one minimum speed and maximum speed of the pump on the controller;

initiating the one or more additional pumps at a predetermined time/frequency rate to meet the set point; and automatically adjusting the at least one operating parameter when the set point is not met.

2. The water control booster system of claim 1, wherein the minimum speed is the speed at which the pump produces flow and increases pressure above an incoming pressure of the water control booster system.

3. The water control booster system of claim 1, wherein the maximum speed is the speed at which the pump can operate without allowing the drive unit to experience an overcurrent.

4. The water control booster system of claim 1, wherein the at least one customizable alarm threshold includes one of an alarm indicating a discharge pressure of water exiting the water booster control system, an alarm indicating a suction pressure, an alarm indicating a status of the one or more drive units, and an alarm indicating a fault condition has been triggered by at least one of a discharge pressure, the suction pressure, and a flow rate.

5. The water control booster system of claim 1, further comprising a network in communication with the controller and a remote device, wherein the remote device is configured to receive the breached alarm threshold.

6. The water control booster system of claim 5, wherein the remote device includes at least one of a networked workstation, a laptop, a smart phone, and a handheld tablet.

7. The water control booster system of claim 1, wherein the controller is a programmable logic controller (PLC) that includes a processor configured to facilitate operation of the water booster control system, the PLC having stored thereon a proportional integral derivative (PID) loop configured to control the at least one operating parameter of the pump.

8. The water control booster system of claim 7, wherein the PID is further configured to calculate a difference between a set process variable and a desired set point, and calculate an error value, based on the calculated difference, to adjust at least one input parameter and operational parameters to minimize the error value.

9. The water control booster system of claim 1, wherein the user interface is a computer implemented user interface that includes a touch-screen display configured for the user to manipulate.

10. A method of operating one of more pumps in a water booster system while in operation, comprising the steps of:

receiving a first pump parameter input through a computer implemented user interface, the first pump parameter defined by at least one of a pump sequence mode selection, a pump rotation selection, and a lead pump selection;

receiving an alarm indicating a fault condition, wherein the alarm is transmitted to an offsite location;

reviewing the alarm and transmitting a response to the one or more pumps; and adjusting the first pump parameter in response to the alarm;

wherein selecting the first pump parameter on the computer implemented user interface includes selecting at least one of a first lead pump and a first lag pump, wherein the first lead pump is configured to rotate during a startup cycle and rotate to the first lag pump in the pump sequence when only one pump is started during the startup cycle;

wherein the first lag pump becomes a new lead pump, and the first lead pump because the first pump to be turned off and the new lead pump is the last pump on in a new start cycle, and wherein the new lead pump is the next pump in the sequence when more than one pump has been started.

11. The method of claim 10 further comprising the step of at least one of viewing and editing the first pump parameter on the computer implemented user interface while the one or more pumps are in operation.

12. The method of claim 10, wherein the pump rotation selection defined by changing a lead pump to another pump when an hours parameter times out when selecting the first pump parameter on the computer implemented user interface includes the pump rotation selection.

13. A method of operating one or more pumps in a water booster system while in operation, comprising the steps of:

receiving a first pump parameter input through a computer implemented user interface, the first pump parameter defined by at least one of a pump sequence mode selection, a pump rotation selection, a lead pump selection, and a lag pump selection; and upon selection of the first pump parameter, operating the one or more pumps according to the at least one of the pump sequence mode selection, the pump rotation selection, the lead pump selection, and the lag pump selection;

wherein selecting the first pump parameter on the computer implemented user interface includes selecting at least one of a first lead pump and a first lag pump, wherein the first lead pump is configured to rotate during a startup cycle and rotate to the first lag pump in the pump sequence when only one pump is started during the startup cycle;

wherein the first lag pump becomes a new lead pump, and the first lead pump because the first pump to be turned off and the new lead pump is the last pump on in a new start cycle, and wherein the new lead pump is the next pump in the sequence when more than one pump has been started.

14. The method of claim 13 further comprising the step of at least one of viewing and editing the first pump parameter on the computer implemented user interface while the one or more pumps are in operation.

15. The method of claim 13, wherein the pump rotation selection defined by changing a lead pump to another pump when an hours parameter times out when selecting the first pump parameter on the computer implemented user interface includes the pump rotation selection.

* * * * *